United States Patent [19]

Kelly

[11] 4,407,150

[45] Oct. 4, 1983

[54] APPARATUS FOR SUPPLYING AND CONTROLLING HYDRAULIC SWAGING PRESSURE

[75] Inventor: John W. Kelly, Burbank, Calif.

[73] Assignee: Haskel Engineering & Supply Company, Burbank, Calif.

[21] Appl. No.: 271,373

[22] Filed: Jun. 8, 1981

[51] Int. Cl.[3] ..... B21D 22/10

[52] U.S. Cl. ..... 72/61; 72/453.02; 29/727; 91/400; 91/410; 91/433; 60/540; 60/541; 60/593

[58] Field of Search ..... 60/540, 547, 537, 593; 91/433, 400, 410; 29/727; 72/61, 399, 453.02, 453.01, 453.18, 482

[56] References Cited

U.S. PATENT DOCUMENTS 3,585,701 1/1969 Stary ..... 29/727

4,189,983 2/1980 Fassbender et al. ..... 91/400

*Primary Examiner*—Francis S. Husar

*Assistant Examiner*—David B. Jones

*Attorney, Agent, or Firm*—Fulwider, Patton, Rieber, Lee & Utecht

[57] ABSTRACT

In an apparatus for forming leak-proof joints between tubes and a tube sheet by the internal application of hydraulic swaging pressure, the flow of pressurized fluid from an adjustable pressure reduction valve is permitted or interrupted by a control valve. An actuator moves the control valve between its flow permitting and interrupting positions in response to a control signal. In the sensor, which is connected to the input and output sides of the control valve, a piston is movable in response to the difference in the input and output pressures to produce the control signal when a predetermined comparative pressure relationship exists.

21 Claims, 3 Drawing Figures

MANDREL
ROTARY SOLENOID
PRESSURE SOURCE
ADJUSTABLE TIME DELAY RELAY

APPARATUS FOR SUPPLYING AND CONTROLLING HYDRAULIC SWAGING PRESSURE

FIELD OF THE INVENTION

The present invention relates to hydraulic swaging in the formation of leak-proof joints between tubes and a tube sheet, and, more particularly, it relates to the automatic control of the swaging pressure.

BACKGROUND OF THE INVENTION

In the construction of a heat exchanger, a large number of tubes must pass through a tube sheet, and leak-proof joints must be formed between the tubes and the sheet. When the heat exchanger is to be used as a part of a nuclear power plant, unusually high standards of reliability are called for since the tube sheet, which is made of steel as much as two-feet thick, may separate heat exchanger zones between which even very small leaks are intolerable. A large number of such joints are included in a single heat exchange and each joint must meet the same high standards of reliability.

Although roller swaging has been used to form tube/-tube sheet joints, hydraulic swaging has proven to be superior. Hydraulic swaging pressures as high as 50,000 p.s.i. can be uniformly applied throughout a selected axial portion of the tube.

A hydraulic mandrel is inserted in the portion of the tube within the tube sheet, and axially separated seals carried by the mandrel define a pressure zone in which the pressure is to be applied. Pressurized fluid is then introduced through the mandrel into a small annular space between the mandrel and the tube to expand the tube radially. Typically the pressure is first generated by a pump and then multiplied by an intensifier before it is supplied to the mandrel.

A skilled worker must insert the mandrel in each tube individually and cause pressure to be applied by the operation of a control valve. Once the valve has been opened, sufficient time must be allowed for the pressure to reach the desired level. For best results, the pressure should be held at that level for a finite time period on the order of magnitude of two seconds. The optimum swaging pressure varies, depending on the specific characteristics of the tube and the tube sheet.

Ideally the swaging apparatus should be automated to the greatest extent possible to reduce the likelihood of human errors. These errors could occur if, for example, the apparatus were not properly adjusted to produce the swaging pressure desired, the operator did not wait for the system pressure to reach the desired level, or the desired swaging pressure level was not held for a sufficient time period.

A primary objective of the present invention is to provide a swaging apparatus for use in forming tube/-tube sheet joints which is automated to reduce the possibility of human error. A further objective is to provide such an apparatus that is easily and simply adjustable for operation at different swaging pressures. A still further objective is the provision of such an apparatus that is highly efficient and permits each of many joints to be formed within a minimum time period.

SUMMARY OF THE INVENTION

An apparatus for swaging tube/tube sheet joints, which is constructed in accordance with the present invention, accomplishes the above objectives. It includes a pressure source, the output of which is supplied to an adjustable pressure reduction valve and to a control valve by which swaging fluid flow can be selectively permitted or interrupted. A pressurization sensor mechanism is connected to both the input and output sides of the control valve and is responsive to the pressure on these two sides to generate a control signal when a predetermined comparative pressure relationship exists. In response to the control signal, an actuator causes the control valve to interrupt the flow.

Preferably, the pressure sensor comprises a cylinder in which a piston is movable to define first and second variable displacement pressure chambers on opposite sides thereof. A switch is responsive to the position of the piston to allow the control signal to reach the actuator.

In a preferred embodiment, described in detail below, the pressurization sensor piston is freely movable within the cylinder in response to the pressures in the first and second chambers. However, the piston has a smaller effective pressure surface in the first chamber than in the second chamber. This can be accomplished by attaching a rod to the piston, the rod riding in a slideway extending from the first chamber. The switch can be operated by the rod.

When the control valve is first turned to its flow-through position to begin the cycle of operation, the fluid flows into an intensifier where the pressure is multiplied and supplied to a swaging mandrel. At this time, only the first chamber is pressurized, but pressure begins to build in the second chamber. Ultimately the piston moves, reducing the size of the first chamber, and closes the switch. An adjustable time delay relay then causes the signal to be transmitted to the actuator to turn the valve again and stop the application of pressure to the mandrel.

Other features and advantages of the present invention will become apparent from the following detailed description, taken in conjunction with the accompanying drawings, which illustrate, by way of example, the principles of the invention.

DETAILED DESCRIPTION OF THE DRAWINGS

DESCRIPTION OF THE PREFERRED EMBODIMENT

Figures 1, 2, 3:
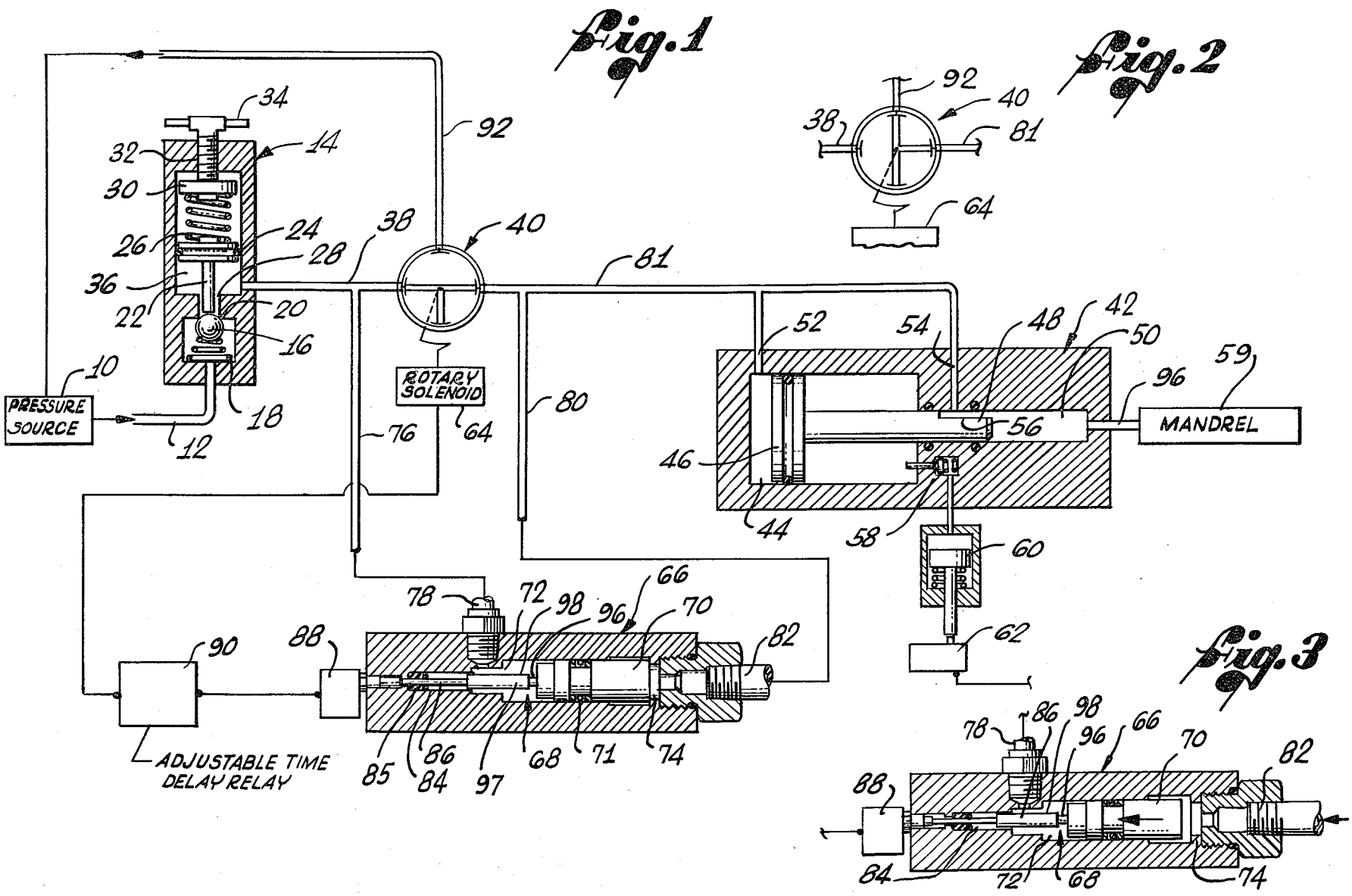
FIG. 1 is a partially diagrammatic illustration of an apparatus constructed in accordance with the present invention, the pressure reduction valve, the pressurization sensor and the intensifier being shown in transverse cross section.
FIG. 2 is a fragmentary diagrammatic view of the control valve of the apparatus in a different position from that of FIG. 1.
FIG. 3 is a cross-sectional view of the pressurization sensor after pressure has been applied to the second chamber.

An apparatus, constructed in accordance with the present invention and shown in FIG. 1, includes a pressure source 10 by which a hydraulic fluid such as water is initially pressurized. Pressure sources of conventional construction include a pump and a reserve tank (not shown separately in the drawings).

From the pressure source 10, pressurized fluid is supplied by a line 12 to the input side of a pressure reduction valve 14. This valve 14 includes, at its bottom end, a ball 16 held by a ball spring 18 against a seat 20 to keep the valve closed. A counter-force is applied from above by a rod 22 that projects downwardly from a piston 24, the piston being urged downwardly by a coil spring 26 so that the force of the piston tends to unseat the ball 16 and allow fluid to flow past the seat 20 through an orifice 28. The top of the coil spring 26 presses against a retainer 30 which is adjustably positioned at the top by a threaded member 32 that is integrally formed with an external handle 34. Thus, by turning the handle 34 and lowering the retainer 30, the upward force on the piston 24 required to raise the piston to the extent that the ball 16 closes against the seat 20 is increased.

Although the adjustable pressure reduction valve 14 is shown in its closed position with the ball 16 against the seat 20 (FIG. 1), the force of the coil spring 26 does overcome the ball spring 18 and push the ball off the seat when the apparatus is completely depressurized. However, the passage of pressurized fluid into a chamber 36 above the seat 20 and below the piston 24 tends to overcome the force of the coil spring 26, allowing the ball 16 to rise closer to the seat. The effect of the counteracting forces of the pressure in the chamber 36 and the coil spring 26 is to retain the ball 16 in a relatively quiescent position in which the output pressure of the valve 14 is reduced to a level corresponding to the position to which the retainer 30 is adjusted.

The reduced pressure hydraulic fluid exits from the chamber 36 by a line 38 leading to a control valve 40. With the control valve 40 in its open or flow-through position (as shown in FIG. 1) the pressurized fluid can flow through the control valve to an intensifier 42. Included in the intensifier 42 is a cylinder 44 in which a relatively large first piston 46 can reciprocate. Attached to the first piston 46 is an axially aligned rod-like second piston 48, the two pistons moving together. The opposite end of the second piston rides in a smaller cylinder 50.

Pressurized fluid from the control valve 40 enters the first cylinder 44 through an inlet 52 so that it pushes the first piston 46 toward the second cylinder 50. Since the second piston 48 and cylinder 50 are of considerably smaller cross-sectional area, the pressure applied to the first piston 46 is greatly multiplied when applied to fluid in the second cylinder.

A second inlet 54 is aligned with a cut-away portion 56 of the second piston 48 to permit pressurized fluid from the reduction valve 14 to directly enter the second cylinder 50 before the pistons 46 and 48 begin to move under the influence of fluid entering the first cylinder 44. The multiplied pressure from the second cylinder 50 is then applied to a mandrel 57. A small air valve 58 is arranged to be actuated by the first piston 46 in the event that that piston, due to a lack of swaging resistance, travels the full length of the first cylinder 44. In that event, the air valve 58 causes an external piston 60 to operate a no-swage switch 62, the significance of which will be explained below.

The flow permitted by the control valve 40 is dependent upon the rotational position of the valve as controlled by a solenoid actuator 64. This solenoid 64 is responsive to an electrical signal originated by a pressurization sensor 66.

A cylinder 68 within the sensor 66 contains a piston 70 which can reciprocate slidably within the cylinder under the sole influence of the fluid pressure acting on it. The piston 70 is surrounded by a pressure seal 71 and movement of the piston is not restrained by any springs or the like. Since the cylinder 68 is longer than the piston 70, the piston defines a first chamber 72 on one side thereof and a second chamber 74 on the opposite side thereof. The sizes of these chambers 72 and 74 depend upon the axial position of the piston, as illustrated in FIGS. 1 and 3.

To influence the position of the piston 70, a first pressure line 76 is connected to the line 38 that connects the pressure reduction valve 14 to the control valve 40, this line being connected to an inlet port 78 that communicates with the first chamber 72. A second pressure line 81 is connected to a line 80 by which pressurized fluid flows from the control valve 40 to the intensifier 42. This pressure line 80 is connected through an axial inlet port 82 at the opposite end of the pressurization sensor 66 so that it communicates with the second chamber 74.

Extending from the first chamber 72 and away from the piston 70 is a slideway 84 in the form of a radially centered axial bore that contains a rod 86 attached to the piston for movement therewith. A seal 85 encircles the rod 86 within the slideway 84. At the end of the slideway 84, where it can be operated by the valve 86, is an electrical switch 88. When closed, the switch 88 delivers an electrical signal to an adjustable time delay relay 90 from which the signal is supplied to the solenoid 64.

The operation of the apparatus will now be explained. When the apparatus is not in use, the control valve 40 is positioned, as shown in FIG. 2, so that it prevents pressurized fluid from flowing from the pressure reduction valve 14 to the intensifier 42. The line 81 by which fluid can be supplied to the intensifier 42 is connected to a return line 92 that permits the intensifier to be depressurized. However, pressurized fluid from the pressure reduction valve 14 does flow through the line 38 up to the control valve 40 and hence flows into the line 76 leading to the first chamber 72 of the pressurization sensor 66. Accordingly, the first chamber 72 is pressurized, whereas no pressure is applied to the opposite side of the piston 70 in the second chamber 74. The piston 70, therefore, moves as far as permitted to one end of the cylinder 68 (as shown in FIG. 1), making the first chamber 72 as large as possible.

The user of the apparatus actuates the solenoid 64, causing the control valve 40 to move from the position of FIG. 2 to the position of FIG. 1 and allowing the pressure reduction valve 14 to communicate with the intensifier 42. Initially, fluid flows into the first and second cylinders 44 and 50 of the intensifier 42 through the first and second ports 52 and 54. The pressure entering the second port 54 pressurizes the second cylinder 50 at a level that approaches the pressure at the output side of the pressure reduction valve 14. However, the larger first piston 46, being exposed to the same pressure, easily overcomes the resistance of the smaller second piston 48 and the two pistons 46 and 48 begin to move together so as to expand the first cylinder 44. Once the cut-away portion 56 of the second piston 48 passes the second port 54, the second chamber 50 no longer communicates with the line 81 from the pressure reduction valve 40. Thereafter, movement of the two pistons 46 and 48 multiplies the pressure applied to the first piston 46 and the intensified pressure is thus supplied to the mandrel 57 through an intensifier outlet 96.

As the first piston 46 moves within the first cylinder 44 of the intensifier 42, pressurized fluid from the pressure reduction valve 14 also flows through the second line 80 on the output side of the control 40 into the second chamber 74 of the pressurization sensor 66. Initially, the pressure in the second chamber 74 is less than the pressure in the first chamber 72 and the piston 70 does not move. However, the pressure in the second chamber 74 continues to rise as the control valve 40 remains open.

It is important to understanding this exemplary apparatus to note the effect of the rod 86. The effective pressure surface of the piston 70 in the first chamber 72 is reduced due to the presence of the rod 86. Because the rod 86 prevents the hydraulic pressure in the first chamber 72 from acting on the entire surface of the piston 70, the force applied to the piston 70 in the second chamber 74 will eventually become greater than the force applied to the piston in the first chamber 72. The reduction in the effective pressure surface areas of the piston 70 is comparatively rather small. In the preferred embodiment, the effective pressure surface of the piston 70 in the first chamber 72 is approximately 95 percent of the effective pressure surface in the second chamber 74, although this proportion may be varied in accordance with the parameters of a particular system.

When the pressure in the second chamber 74 reaches 95 percent of the pressure reduction valve input pressure as applied to the first chamber 72, the piston 70 will move in a direction which reduces the size of the first chamber 72 (from the position of FIG. 1 to the position of FIG. 2). As the piston 70 moves, the rod 86 will operate the switch 88 to provide a control signal to the adjustable time delay relay 90. After the delay to which the relay 90 has been set has expired, the control signal will be supplied to actuate the solenoid 64, returning the control valve 40 to the position shown in FIG. 2 and thereby allowing the intensifier 42 and the mandrel 57 to be depressurized.

It will be noted that the exact configuration of the rod 86 is not critical. In this embodiment, the rod 86 has an enlarged portion 97 within the first chamber 72. However, it is the area of the rod 86 as it passes through the seal 85 that represents the actual reduction of the effective piston surface. Any changes in the cross section of the rod 86 between the seal 85 and the piston 70 have no significant hydraulic effect.

Particular attention should be given to the delay introduced by the relay 90. It is noted that the switch 88 is operated before the intensfier 42 and the mandrel 57 reach the full output pressure of the pressure reduction valve 14, in this case at 95 percent of that pressure. However, the pressure is rising rapidly at that point and the time delay can be adjusted, based on empirical results, to a level that allows full pressure to be reached before the solenoid 64 is operated by the output of the relay 90. The delay should, however, be longer than that required merely to reach this maximum pressure. The delay should allow the system to dwell briefly at that maximum pressure for a time period sufficient to achieve the desired optimum joint between the tube and the tube sheet.

An important feature of the apparatus of this invention is that only one adjustment need be made when it is desired to alter the swaging pressure. This is the adjustment of the pressure reduction valve 14 by properly positioning the retainer 30. Although the pressure directly adjusted in this way is the output pressure of the pressure reduction valve 14, the output pressure of the intensifier 42 is always proportionate. It is not necessary to make any adjustments to the pressurization sensor 66, because it is responsive to the comparative pressures on the input and output sides of the control valve 40. Thus, the switch 88 will always be operated when the output side pressure applied to the second chamber 74 reaches a fixed percentage of the pressure in the first chamber 72. This proportionate relationship will hold true for all pressures to which the system might be set. There is no possibility of an error occurring due to a failure to set the pressure sensor 66 which terminates the swaging cycle at a level commensurate with the setting of the pressure reduction valve 14.

The operation of the no-swage switch 58 should also be noted. It becomes operational in the event that the tube is not effectively swaged within the tube sheet due to, for instance, a leak downstream of the intensifier 42. Such a leak could occur if, for example, the mandrel 57 were not properly sealed to the surrounding tube surface, in which case pressure would be lost. The absence of pressure resisting movement of the pistons 46 and 48 would quickly cause those pistons to move until the first piston 46 reached the end of the first chamber 44, operating the valve 58 and hence the switch 62. The switch 62 would then activate a no-swage indicator (not shown) so the operator would be aware of the fact that a proper joint had not been formed.

The present invention, although of a simple construction involving relatively few moving parts, is capable of providing reliable swaging of tubes. The possibility of human error is minimized, particularly because of the extreme simplicity of setting the swaging pressure.

While a particular form of the invention has been illustrated and described, it will be apparent that various modifications can be made without departing from the spirit and scope of the invention.

I claim:

1. In an apparatus for forming leak-proof joints between tubes and a tube sheet by the internal application of hydraulic swaging pressure through a mandrel inserted within said tubes, a mechanism for supplying and controlling the swaging pressure comprising:

pressure source means for pressuring a fluid;

pressure reduction valve means arranged to receive pressurized fluid from said pressure source means for reducing the pressure of said fluid to a selected level;

control valve means connected to said reduction valve means for selectively permitting or interrupting the flow of said fluid from said reduction valve means to said mandrel;

pressurization sensor means connected to the input and output sides of said control valve means and responsive to the pressures of said input and output sides for generating a control signal when a predetermined comparative relationship exists between said pressures; and actuator means for causing said control valve means to interrupt said flow in response to said control signal.

2. The apparatus of claim 1 further comprising means for delaying said control signal before it reaches said actuator means.

3. The apparatus of claim 2 wherein said actuator means is a solenoid.

4. The apparatus of claim 1 wherein said pressurization sensor means comprises:

a cylinder;

a piston movable within said cylinder to define first and second variable displacement pressure chambers on opposite sides thereof, said first chamber being connected to said input side and said second chamber being connected to said output side; and switch means responsive to the position of said piston.

5. The apparatus of claim 4 wherein said piston has first and second effective pressure surface areas within said first and second chambers, respectively, on which said pressurized fluid can act to cause movement of said piston, said first area being smaller than said second area.

6. The apparatus of claim 5 wherein said piston is freely movable in said cylinder in response to pressure in said first and second chambers.

7. The apparatus of claim 4 further comprising a slideway extending from said first chamber and a rod slidable in said slideway and attached to said piston, whereby said rod reduces the effective pressure surface area of said piston responsive to the pressure in said first chamber, and whereby the effective pressure surface area of said piston in said first chamber is smaller than the effective pressure surface area of said piston in said second chamber.

8. The apparatus of claim 7 wherein said piston is freely movable in said cylinder in response to pressure in said first and second chambers.

9. The apparatus of claim 7 wherein said switch is arranged to be operated by said rod upon movement of said piston.

10. In an apparatus for forming leak-proof joints between tubes and a tube sheet by the internal application of hydraulic swaging pressure within said tubes, a mechanism for supplying and controlling the swaging pressure comprising:

a pressure source;

adjustable pressure reduction valve means arranged to receive pressurized fluid from said source for reducing the pressure of said fluid to a selected level;

intensifier means arranged to receive pressurized fluid from said reduction valve means for multiplying said pressure;

a swaging mandrel arranged to receive pressure multiplied by said intensifier means;

control valve means connected between said reduction valve means and said intensifier for selectively permitting or interrupting the flow of said fluid from said reduction valve means to said intensifier means;

pressurization sensor means for generating a control signal when a predetermined relationship exists between the pressures on the input and output sides of said control valve, said pressurization sensor means comprising a piston, a cylinder within which said piston is slidable to define first and second variable displacement pressure chambers on opposite sides thereof, said first pressure chamber being connected between said reduction valve means and said control valve means and said second chamber being connected between said control valve means and said intensifier means, and a switch responsive to movement of said piston in a direction that reduces or eliminates said first chamber; and actuator means connected to said switch for causing said control valve to interrupt said flow in response to a signal from said pressurization sensor means.

11. The apparatus of claim 10 wherein said piston has first and second effective pressure surface areas within said first and second chambers, respectively, on which said pressurized fluid can act to cause movement of said piston, said first area being smaller than said second area.

12. The apparatus of claim 10 wherein said piston is freely movable in said cylinder in response to pressure in said first and second chambers.

13. The apparatus of claim 10 further comprising means for delaying said control signal before it reaches said actuator means.

14. The apparatus of claim 10 wherein said actuator means is a solenoid.

15. The apparatus of claim 10 further comprising:

a slideway extending from said first chamber;

a rod slidable in said slideway and attached to said piston; and a seal surrounding said rod within said slideway, whereby said rod reduces the effective pressure surface area of said piston subject to the pressure in said first chamber.

16. The apparatus of claim 15 wherein said switch is arranged to be operated by said rod upon movement of said piston.

17. In an apparatus for forming leak-proof joints between tubes and a tube sheet by the internal application of hydraulic swaging pressure within said tubes, a mechanism for supplying and controlling the swaging pressure comprising:

a pressure source;

adjustable pressure reduction valve means arranged to receive pressurized fluid from said source for reducing the pressure of said fluid to a selected level;

intensifier means arranged to receive pressurized fluid from an output side of said control valve for multiplying said pressure;

a swaging mandrel arranged to receive pressurized fluid from said intensifier;

control valve means connected between said reduction valve means and said intensifier means for selectively permitting or interrupting the flow of said fluid from said reduction valve means;

pressurization sensor means for generating a control signal when a predetermined comparative relationship exists between the pressures on the input and output sides of said control valve, said pressurization sensor means comprising a piston, a cylinder within which said piston is freely slidable in a reciprocating manner to define first and second variable displacement pressure chambers on opposite sides thereof, said first chamber being connected between said reduction valve means and said control valve means and said second chamber being connected between said control valve means and said intensifier means, a slideway extending from said first chamber, a rod slidable in said first slideway and attached to said piston for movement therewith, a seal surrounding said piston within said slideway whereby said rod reduces the surface area of said piston subject to pressure in said first chamber and whereby the effective pressure surface of said piston in said first chamber is smaller than the effective pressure surface of said piston in said second chamber, and an electrical switch responsive to movement of said piston in a direction that reduces or eliminates said first chamber;

solenoid actuator means electrically connected to said switch for causing said control valve to interrupt said flow in response to a signal from said pressurization sensor means; and delay means electrically connected between said switch and said actuator means for delaying said control signal.

18. In an apparatus for forming leak-proof joints by the application of hydraulic swaging pressure through a mandrel inserted in a tubular structure, a mechanism for supplying swaging pressure comprising:

pressure source means for pressuring a fluid;

control valve means for selectively permitting or interrupting the flow of said fluid from said pressure source means to said mandrel;

pressurization sensor means connected to input and output sides of said control valve means and responsive to the pressures of said input and output sides for generating a control signal when a predetermined comparative relationship exists between said pressures; and actuator means for causing said control valve means to interrupt said flow in response to said control signal.

19. The apparatus for claim 18 further comprising means for delaying said control signal before it reaches said actuator means.

20. The apparatus for claim 18 wherein said pressurization sensor means comprises:

a cylinder;

a piston movable within said cylinder to define first and second variable displacement pressure chambers on opposite sides thereof, said first chamber being connected to said input side and said second chamber being connected to said output side; and switch means responsive to the position of said piston.

21. The apparatus of claim 20 wherein said piston has first and second effective pressure surface areas within said first and second chambers, respectively, on which said pressurized fluid can act to cause movement of said piston, said first area being smaller than said second area.

* * * * *